US005535591A

United States Patent [19]

Priesemuth

[11] Patent Number: 5,535,591

[45] Date of Patent: Jul. 16, 1996

[54] UNDERGROUND POWER PLANT

[76] Inventor: Wolfgang Priesemuth, Postkamp 13, 25524, Breitenburg-Nordoe, Germany

[21] Appl. No.: 276,042

[22] Filed: Jul. 14, 1994

[30] Foreign Application Priority Data

Jul. 15, 1993 [DE] Germany ..... 43 23 768.1

[51] Int. Cl.[6] ..... F01K 3/00; F01K 13/00

[52] U.S. Cl. ..... 60/670; 60/645; 60/659

[58] Field of Search ..... 60/670, 645, 641.4, 60/659

[56] References Cited

U.S. PATENT DOCUMENTS

| | | | |
|---|---|---|---|
| 4,275,310 | 6/1981 | Summers et al. | 60/659 |
| 4,319,458 | 3/1982 | Berkley | 60/670 |
| 5,058,386 | 10/1991 | Senanayake | 60/670 |

FOREIGN PATENT DOCUMENTS

| | | | |
|---|---|---|---|
| 0498700 | 5/1930 | Germany | 60/641.2 |

*Primary Examiner*—Denise L. Gromada
*Assistant Examiner*—Alfred Basichas
*Attorney, Agent, or Firm*—Jacques M. Dulin; Frederick J. Zustak

[57] ABSTRACT

Underground powerplant system for the generation of energy, in particular electrical energy, comprising a coal fired steam generator, whose steam drives a turbine which delivers electrical energy. The coal-fired steam driven electrical generation system of the invention is installed underground in a coal mine. Waste fly ash (with or without sorbent) bottom ash and slag can be disposed in the abandoned or exhausted mining area. Ambient mine water can be employed in one or more of the process operations.

10 Claims, 1 Drawing Sheet

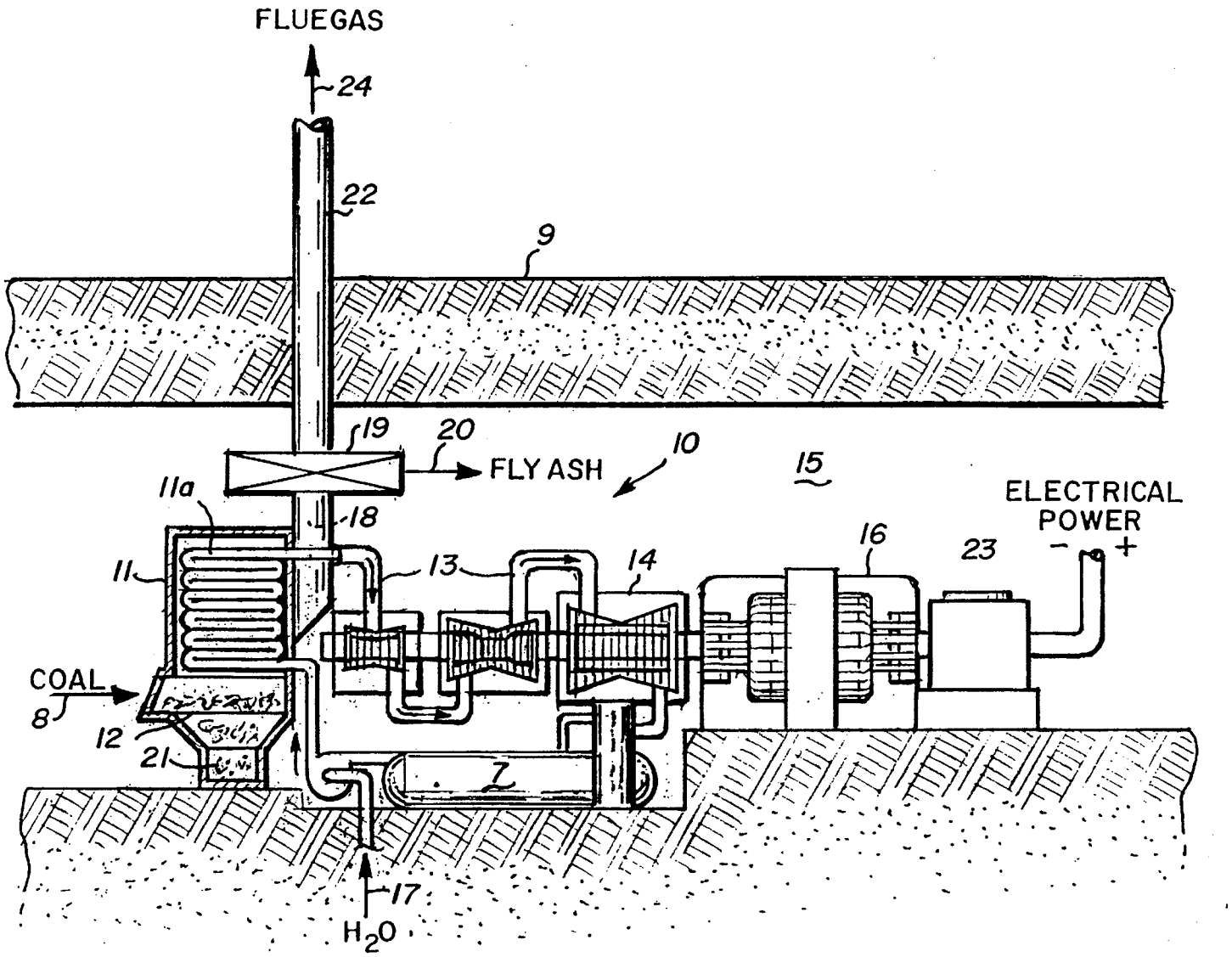
FLUEGAS
24
22
9
19
20
FLY ASH
18
10
11a
11
13
14
15
16
23
ELECTRICAL POWER
+
-
7
17
$H_2O$
21
12
COAL
8

UNDERGROUND POWER PLANT

FIELD

The present invention relates to a power plant system for the generation of energy, in particular electrical energy, comprising a coal driven steam generator, e.g. a boiler, whose steam drives a turbine, which delivers energy via an electrical generator, in which at least the steam generator is installed underground in association with a coal mine.

BACKGROUND

It is known that underground mining of coal is highly expensive, and after extraction the coal has to be transported over long distances, e.g. to be used in conventional coal power stations for the generation of electrical energy. It is also known that coal power stations, generally even those equipped with the most sophisticated filter devices for the filtration of exhaust gases (such as baghouses, cyclones, scrubbers or electrostatic precipitators) which result from the combustion of coal, produce considerable amounts of filtrated material (typically fly ash). This ash must be disposed-of or utilized as construction material, (e.g., fill) or as an admixture for construction materials (e.g. concrete aggregate). In addition, conventional coal power stations naturally produce, due to the combustion of coal, considerable amounts of bottom ash and slag, which must be disposed-of or used for another appropriate purpose.

Under the aspect of the protection of the environment as well as the environmental impact, coal power stations are highly problematic, due to the necessity of providing environmentally acceptable disposal sites for the waste ash and slag and also the filtrated fly ash collected. Due to the long distances which have to be overcome for transportation between the location of coal extraction, the locations of the use of coal in the power station and the location of the disposal site, the price of the energy generated by the coal station is increased by a considerable degree.

THE INVENTION

OBJECTS:

It is among the objects of the present invention to provide a power station system for the generation of energy, in particular electrical energy, which on the one hand, contrary to conventional coal power stations, does not need a disposal area for the filtrated material (fly ash) which necessarily results from the operation of the coal power station, and on the other hand the coal does not have to be transported over long distances immediately after its extraction, but can directly be supplied to the power station and the resultant slag and ash likewise do not have to be transported over long distances for disposal, which station can be operated more ecologically and more cost-effectively than regular coal power stations, and whereby additionally, the energy generated by the device according to the invention can be made available at lower cost compared to the energy generated by conventional coal power stations today.

Still other objects will be evident from the FIGURE, the Specification and the claims of this application.

DRAWINGS:

The invention is described in reference to the drawing in which:

The FIGURE is a schematic illustration of the electrical generating system (power station) of the invention, installed underground, along with a flue gas filter device, which is provided in the exhaust gas steam of the coal driven steam generator.

SUMMARY:

The invention comprises an energy generating system, typically a power station, in which at least the steam generator is arranged underground in a coal mine. Being disposed in a mine shaft or chamber, combustion air is provided by the air contained in the mine. Fresh air is drawn into the coal mine by the conventional openings associated with a mine, as the air is used in the combustion process. Alternately, it is well known that forced air ventilation is used to replenish the air in an underground mine environment and some of this air may be made available for combustion air. The main advantage of this system according to the invention is that directly at the location of coal extraction, the generating system of the invention can be operated with all its resulting advantages, i.e., there is practically no transport of coal between the direct location of coal extraction and of its use, and the resultant slag residue or ash and the filtrated material (e.g., fly ash or ash and sorbent) of exhaust gas can stay directly underground, for instance to fill up exhausted day drifts or galleries, respectively, from where the coal is extracted. Until now, this required considerable effort, due to the requirement for disposal space which can now be omitted, since the residue of coal combustion can be simply used for refilling the same galleries resulting from the extraction of coal. Another main advantage of the power system according to the invention is that it does not disturb urban and rural planning, since the system is installed underground and does not significantly project above ground. It is an accompanying advantage that the system of the invention can be directly installed in mines in housing or industrial areas, with the further advantageous consequence that the electrical energy does not have to be transported over long distances, i.e. overhead transmission lines for transmitting electrical energy from the power station to the direct location of use are not required.

It is preferred that the system is advantageously arranged with the turbine also installed underground, although this is not essential in every case, as it is possible to direct the steam generated by the steam generator to a turbine or a turbine system which is installed above ground. However, if the turbine is installed underground, heat loss is reduced and long, costly movement of steam is not required.

The generating system of the invention generates mechanical energy via a steam turbine. To be able to generate electrical energy, the turbine is connected with an electrical generator. In this case, the generator can be installed advantageously underground, provided the turbine is installed underground, so that the main components of the power system are completely installed underground, which allows a compact construction of the whole system.

It is also an advantage for the feed water to be used for the steam generator to be drawn in whole or in part from mine water extracted or resulting from the coal mining operation. That is, the water that naturally results in most cases of mining, which until now had to be extracted and disposed-of separately out of the pits or the day drifts of the mine, can now be used directly at the installation location as part or all of the feed water for driving the steam generator (boiler) or for driving the turbine. Likewise it can be used as cooling, condensation or scrubbing water for the whole power plant system.

In another alternative configuration for the power plant system of the invention, the pollutants from the exhaust gas which results from coal combustion are filtered out underground via a filter device such as a electrostatic precipitator, scrubber, baghouse and/or cyclone. The result is that the exhaust gas emissions from the generating system of the invention are substantially free of pollutants (such as $SO_x$, $NO_x$ and fly ash), to an acceptable level, apart from the necessarily resultant residual elements of carbon dioxide, water vapor and other non-filterable elements.

The invention also includes disposal of the pollutants which are recovered in the filtration process directly at the location underground. These wastes, principally flyash and $SO_x/NO_x$ sorbents, are preferably used for filling up the exhausted day drifts. Likewise, bottom ash or slag, resulting from the combustion of coal in the boiler are deposited underground.

DETAILED DESCRIPTION OF THE BEST MODE OF THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

The FIGURE illustrates a power generating system 10, typically of conventional power plant construction for coal power stations specially adapted for underground installation and operation. Generating system 10 comprises a boiler-type steam generator 11, which is fueled with coal 8. As can be seen in the FIGURE, the underground cavity 15 is an open part of the mining complex and combustion air is drawn from the cavity. The combustion product flue gas is vented to above the surface via the flue. Since it is well known that mine shafts and chambers require abundant ventilation by either forced air ventilation, using fans, and/or by natural ventilation from multiple ventilation shafts, providing for replenishment combustion air is straight-forward and easily accomplished. Steam 13 is generated in the conventional manner via the heat exchanger (boiler tubes 11*a*) as a component of the steam generator (boiler) 11. The steam drives a single turbine or a multi-stage turbine system 14. For the purpose of the generation of electrical energy, turbine 14 is connected with generator 16 and optionally, a transformer 23.

Feed water 17 for the operation of the steam generator 12 or the turbine 14 is provided from the resultant ambient underground water and may be purified as needed in water treatment system 7. Moreover, the resultant underground water can also be used for cooling the system, in general for condensation of steam, emitted by the turbine 14.

The boiler exhaust gas 18 emitted by the steam generator (boiler) 11 passes through a filter device 19, e.g., a conventional EP, BH, Scrubber or Cyclone, so that the flu gases emitted via stack 22 by the plant 10, can leave the mine as a filtrated exhaust gas 24 above the surface 9, i.e., it can be extracted out of the coal mine.

The pollutant 20 (e.g. fly ash plus $SO_x/NO_x$ sorbent) recovered in the filter device 19, is disposed directly in the exhausted day drifts, i.e., it will be deposited there in a very ecological manner, so there is no danger of any pollution of the water close to the surface. Thus, the resultant waste ash 20 is used directly for filling up the day drifts of exhausted mines.

Bottom ash clinker, and/or slag 21, resulting from coal combustion, likewise can be deposited directly into the unused or exhausted day drifts, or the ash is used for filing up these day drifts.

The complete power generation system 10 is arranged directly in an underground cavern 15 of a coal mine, and therefore can be used even below housing and industrial areas in which mining takes place without disturbing influences on the environment above ground, be it acoustic, optical or other nature. Thus, power system 10 can also be considered an optimal answer for environmental power generation by arranging a large number of somewhat smaller power stations in a decentralized manner. The invention thus economically supports the tendency away from a few giant, distantly located power stations.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. Method of underground power generation comprising the steps of:

a) providing an underground coal mine cavity sized to receive a steam boiler, to provide steam;

b) directing steam produced by said boiler to a turbine located underground in association with said boiler, and c) powering an electrical generator by said turbine, said electrical generator being disposed underground in association with said turbine.

2. Method of underground power generation as in claim 1 which includes the steps of:

a) filtering fly ash and/or $SO_x/NO_x$ pollutants out of flu gases from said boiler;

b) collecting said fly ash; and c) disposing said fly ash in exhausted drifts of said coal mine.

3. Method of underground power generation as in claim 2 which includes the steps of:

a) collecting bottom ash from said boiler; and b) disposing collected bottom ash in exhausted drifts of said coal mine.

4. Method of underground power generation as in claim 3 which includes the steps of:

a) recovering ambient mine water resulting from mining operations in said coal mine;

b) employing said recovered mine water in said power generation system.

5. Method of underground power generation as in claim 4 which includes the steps of:

a) pretreating said water before use in said power generation system.

6. System for the generation of energy, in particular electrical energy, comprising in operative combination:

a) a coal driven steam generator installed underground in a coal mine, the steam from which drives a turbine which delivers electrical energy for local distribution;

b) means for removal and collection of particulate pollutants from exhaust gas resulting from combustion of coal, said pollutant removal means being disposed underground in cooperative association with said steam generator; and c) the particulate pollutants removed by said pollutant removal means being disposed underground; and d) bottom ash resulting from the combustion of coal being disposed underground.

7. Electrical energy generation system according to claim 6, wherein the turbine is installed underground.

8. Electrical energy generation system according to claim 7, which includes an electrical generator connected to the turbine.

9. Electrical energy generation system according to claim 8, wherein the generator is also installed underground.

10. Electrical energy system according to claim 6, which includes means for providing feed water for the steam generator from underground water associated with coal mine operations.

* * * * *